US006934400B1

(12) United States Patent
Vonlanthen

(10) Patent No.: US 6,934,400 B1
(45) Date of Patent: Aug. 23, 2005

(54) METHOD FOR CONTROLLING THE DYNAMIC RANGE OF A HEARING AID, AND METHOD TO MANUFACTURE DIFFERENT HEARING AIDS, AND A HEARING AID

(75) Inventor: Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/706,188

(22) Filed: Nov. 3, 2000

(51) Int. Cl.[7] ..... H04R 25/00

(52) U.S. Cl. ..... 381/320

(58) Field of Search ..... 381/23.1, 162, 381/312, 313, 314, 316, 315, 320, 321, 384, 381/FOR 140, FOR 130, FOR 131, 317, 381/318, 328, 330, 400, 413, 417, 418, 401; 379/390.01, 390.03, 394, 395

(56) References Cited

U.S. PATENT DOCUMENTS 4,548,082 A * 10/1985 Engebretson et al. ..... 381/320
5,189,704 A * 2/1993 Krauss ..... 381/321
5,321,758 A * 6/1994 Charpentier et al. ..... 381/320
5,861,779 A 1/1999 Loeppert et al.

FOREIGN PATENT DOCUMENTS

DE 3036417 A1 3/1982

* cited by examiner

*Primary Examiner*—Curtis Kuntz
*Assistant Examiner*—Brian Ensey
(74) *Attorney, Agent, or Firm*—Pearne & Gordon LLP

(57) ABSTRACT

A method to control the dynamic range of a hearing device, which comprises at least one acoustic/electric input transducer followed by a signal processing unit which in turn is operationally connected to an electric/mechanical output transducer, by selectively switching an input impedance of the electric/mechanical transducer from one value to another.

15 Claims, 1 Drawing Sheet

METHOD FOR CONTROLLING THE DYNAMIC RANGE OF A HEARING AID, AND METHOD TO MANUFACTURE DIFFERENT HEARING AIDS, AND A HEARING AID

BACKGROUND OF THE INVENTION

The present invention relates to a method for controlling the dynamic range of a hearing device, a method for manufacturing different kinds of hearing devices exhibiting different transfer functions, and a hearing device fitted with at least one acoustic/electric input transducer and also an electromechanical transducer.

Typical hearing aids comprise at least one acoustic/electric input transducer followed by a signal processing unit of which the output drives an electric/mechanical transducer. As regards digital hearing aids, the signal processing unit is correspondingly digital and comprises an input-side analog/digital converter and as called for an output-side digital/analog converter. This is the case both for in-ear hearing aids and behind-the-ear hearing aids, the output-side electric/mechanical transducer usually being in the form of a loudspeaker unit fitted with a drive coil, but it applies also to implant hearing aids (cochlea implant) of which the output-side electric/mechanical transducer is fitted with a mechanical drive element.

BRIEF SUMMARY OF THE INVENTION

The objective of the present invention is to make it possible for such a hearing aid—where the term also definitely includes ear phones and hearing accessories for hearing-impaired individuals—to adjust the particular appropriate dynamic range using the simplest means. To that end the initially cited control method is characterized in that the input impedance of the acoustic/mechanical transducer is selective switched.

Accordingly the invention is based on the insight that the dynamic range set at a hearing aid of the cited kind, depends also in significant manner on the input impedance of the electric/mechanical transducer. Simply by switching this input impedance to different impedance values, the said dynamic range then can be selected in very easy manner. As regards hearing accessories, the dynamic range can be changed according to the hearing impairment to be remedied or, depending on locale, it may be changed according to the perceived acoustic environment, or, with respect to ear phones, according to the requirements at the time.

Selective switching of the input impedance can be implemented in a preferred embodiment of the method of the invention when fitting the hearing aid, in particular the hearing accessory, for instance by the audiologist, in order to attain a desired dynamic range.

In addition to or instead of the selective input-impedance switching during hearing-aid fitting, the invention proposes that the switching be carried out by means of the signal processing unit, that is in adaptation to the particular acoustic environment.

Moreover the switching of the input impedance may be carried out automatically as mentioned above by means of signal processing, and/or it may be initiated outside the hearing aid, whether manually at the hearing aid itself, in particular as regards an ear phone or an outside-the-ear hearing accessory, for instance by remote control, if called for and preferably in combination with a remote control driving the signal processing unit.

The concept of the invention also makes it possible to manufacture various kinds of hearing accessories in more economical manner than when a particular model-specific dynamic zone must be implemented per se in terms of hardware and software for each particular model. According the above-cited manufacturing process, this goal of the invention is attained in that the various hearing-aid models exhibit the same design and in that the dynamic range specific to a given model is set by selectively switching the input impedance of the electric/mechanical transducer. In this way the manufacture of various hearing-aid models can be focused on the manufacture of a single basic model of a hearing aid, and to select thereupon by means of the switching of the invention the particular required dynamic range.

The above technical problem can be solved concretely by a hearing aid of the invention defined in claim 7 and including preferred embodiment variations defined in claims 8 through 11.

Claim 12 moreover proposes an electro-mechanical transducer for a hearing aid with integrated means to carry out the method of the invention. In this manner the invention offers a transducer module allowing simple manufacture and which can be integrated directly, so that additional and considerable assembly steps can be avoided in the manufacture of the hearing aid.

BRIEF DESCRIPTION OF THE DRAWINGS

The invention is illustratively elucidated below in relation to the attached Figures.

DETAILED DESCRIPTION OF THE INVENTION

Figure 1:
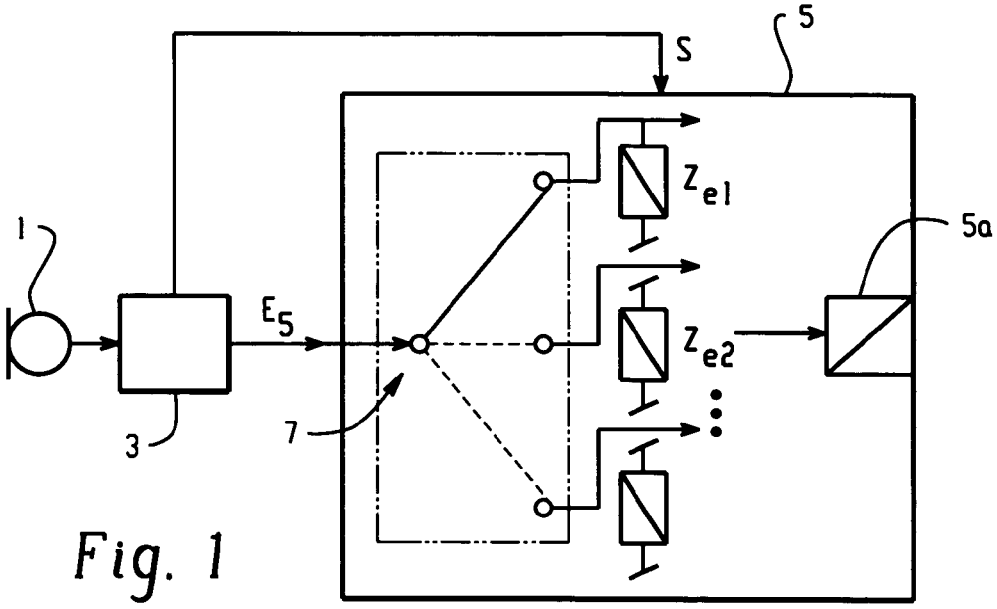
FIG. 1 is a simplified functional-block and signal-flow diagram showing the principle of the method or of a hearing aid of the invention with an integrated transducer of the invention, FIG. 2 schematically shows an electric/mechanical transducer unit of the invention in the form of a loudspeaker module and fitted with an inductive source to carry out the control method of the invention, and FIG. 3 schematically shows various ways of implementing the input-impedance control of the invention.

As shown in FIG. 1, a hearing aid, for instance an ear phone or—and in particular—a behind-the-ear or in-ear hearing accessory, though also a cochlear implant, comprises an input-side acoustic/electric transducer 1 followed by a signal processing unit 3 which in the case of a digital hearing aid shall be a digital processor unit. An electric/mechanical transducer unit 5 is present at the output side of the signal processing unit 3.

As schematically indicated in FIG. 1, the transducer unit 5 include the actual electric/mechanical transducer 5*a* exhibiting an impedance "e" at the input E5 of the transducer unit 5. In the invention, the input impedance e of the transducer 5*a* can be switched, by the switch 7 driven by means of a control input S, to various impedances e1, e2, . . . in the manner schematically shown in FIG. 1. As shown in dashed lines in FIG. 1, the invention provides, switches which by means of a control input S allow switching the input impedance e of the output-side electric/mechanical transducer to given, previously selected impedances.

Figure 3:
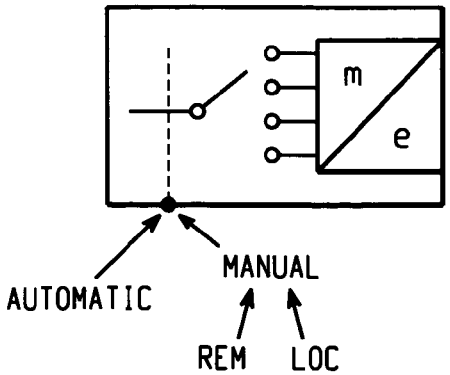

As shown in FIG. 3, the control of input-impedance switching basically can be carried out manually, whether by direct local action Loc on a switching element or by a remote drive Rem, in particular using remote control anyway present to drive the signal processing unit. The particular selective control of the input impedance e of the electric/mechanical transducer lower—possibly possibly in combination with manual control—also can be automatically initiated by the signal processing unit 3 as shown in FIG. 1. In this manner and in practically adaptive manner, the dynamic range of the hearing aid can be made to automatically follow the switched-on operational mode at the processing unit and moreover practically as a function of the acoustic environment.

Depending on the design of the electric/mechanical transducer, in particular of its discrete impedance elements determining the input impedance, the switch 7 can be a separate and independent unit integrated between the output of the signal processing unit 3 and the input of the transducer. Preferably, and as also shown in FIG. 2, such a switch shall be integrated into a modular, electric/mechanical transducer 15.

Figure 2:
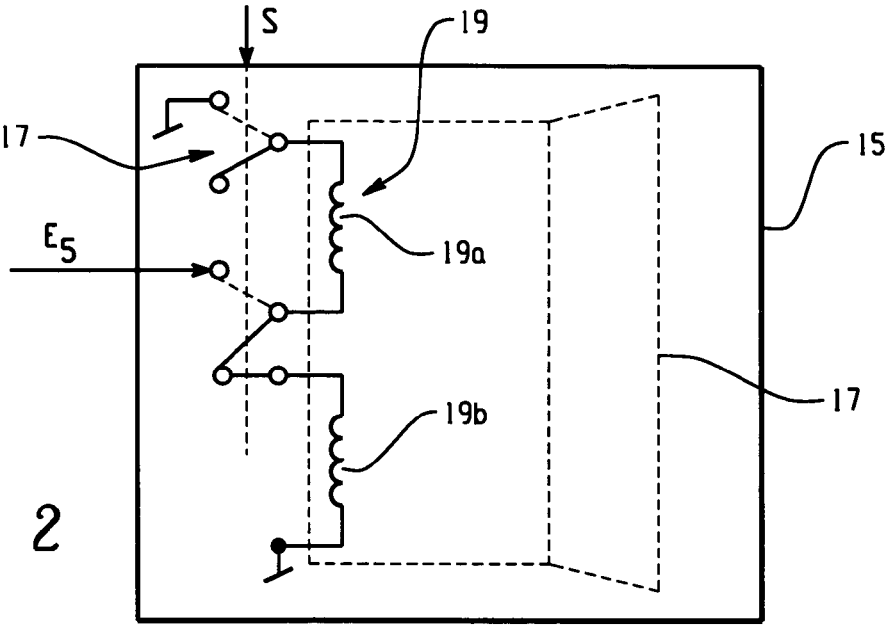

FIG. 2 schematically shows an electric/mechanical transducer 17 conventionally used in such a transducer module 15 of hearing aids and in the form of a loudspeaker fitted with an inductive drive 19. Illustratively the drive 19 comprises two coils 19*a*, 19*b*. These coils 19*a*, 19*b* and connected either in series or parallel by the switch 17 and as a result the input impedance of the module 15 which is determined at least in part by said coils shall be switched. Obviously more than two states of input impedance may be easily attained in selectively switched manner, namely by selectively connecting the discrete impedances provided either in parallel or in series circuits and thus to implement the particular desired input impedance.

As regards a hearing accessory, any requiring fitting, in particular of the transfer function of the signal processing unit by the audiologist to the particular individual requirements, is carried out by initially switching ON the particular desired input impedance. Such a switching configuration can then be retained until there is a need for modification, again carried out by an expert such as the audiologist, or, if based on the initial setting, it may be carried out automatically or manually by the wearer switching the input impedance while using the hearing aid. By providing a reset feature, for instance by manually actuating the signal processing unit a preferred option is attained, namely to reset the cited input impedance anytime to the expert's initial setting.

On one hand the method of the invention allows switching the hearing-aid dynamic range using the very simplest means, and on the other hand, as regards the manufacture of hearing aids differing only by their dynamic ranges, to manufacture them simultaneously and to freeze the class of model only after manufacture proper by selecting said input impedance and hence the dynamic range, and possibly only by fitting by an expert such as said audiologist.

What is claimed is:

1. An electrical/mechanical converter module with a size adapted to be mounted into a hearing aid device comprising:

an input for an electrical signal to be converted into a mechanical output signal, said input having an input impedance, and an impedance control input, wherein a control signal is applied to said control input for controlling said input impedance and said impedance is controlled to adapt said module to any one of a plurality of electrical signal output devices having different electrical characteristics.

2. The converter module of claim 1, further comprising an electrical/mechanical converter with an inductive driver arrangement, said input impedance comprising an impedance of said driver arrangement.

3. The converter module of claim 2, wherein said driver arrangement comprising at least two inductance, said control input controlling activation of at least one of said at least two inductance as a driver inductance.

4. The converter module of claim 1, wherein said input impedance being defined by at least two discreet impedance elements, said control input controlling interconnection of said at least two discreet impedance elements.

5. The converter module of claim 1, wherein said input impedance comprises at least one inductance.

6. The converter module of claim 1, wherein said input impedance comprising at least two inductances, said control input controlling interconnection of said at least two inductances.

7. A hearing device comprising:

an electrical/mechanical output converter, wherein said electrical/mechanical output converter is included into an electrical/mechanical converter module with an input for an electrical signal to be converted into a mechanical output signal, said input having an input impedance, said module further having an impedance control input, wherein a control signal is applied to said control input for controlling said input impedance and said impedance is controlled to adapt said module to any one of a plurality of electrical signal output devices having different electrical characteristics.

8. The hearing device of claim 7, wherein said converter has an inductive driver arrangement, said input impedance of said module comprising an impedance of said inductive driver arrangement.

9. The hearing device of claim 8, wherein said driver arrangement comprises at least two inductances, said control input controlling activation of at least one of said at least two inductances as a driver inductance.

10. The hearing device of claim 7, wherein said input impedance of said module comprises at least two discreet impedance elements, said control input to said module controlling interconnection of said at least two discreet impedance elements.

11. The hearing device of claim 7, wherein said input impedance of said module comprises at least one inductance.

12. The hearing device of claim 7, wherein said input impedance of said module comprises at least two inductances, said control input controlling interconnection of said at least two inductances.

13. The hearing device of claim 7, further comprising a digital signal processing unit with a control output being operationally connected to said control input.

14. The hearing device of claim 7, wherein said control input of said module is operationally connected to a manually operatable control member.

15. A method of manufacturing a set of hearing devices, comprising the step of:

providing a first part of each of said hearing devices with an output for an electrical signal to be electrically/mechanically converted;

providing to each device of said set an equal electrical/mechanical converter module with an input for an electrical signal to be electrically/mechanically converted, said input having an input impedance, said module having an impedance control input, wherein a control signal is applied to said control input for controlling said input impedance and said impedance is controlled to adapt said module to any one of a plurality of said first parts having different electrical characteristics;

operationally connecting at each device of said set the output of said first part to the input of said module; and adapting each of said modules respectively to individual needs of the respective device by adapting said input impedance of said module via said control input.

* * * * *